US008573356B1

(12) United States Patent
Perdue

(10) Patent No.: US 8,573,356 B1
(45) Date of Patent: Nov. 5, 2013

(54) ADJUSTABLE DEVICE FOR ACOUSTIC MODIFICATION

(71) Applicant: Joab Jay Perdue, Erin, TN (US)

(72) Inventor: Joab Jay Perdue, Erin, TN (US)

( * ) Notice: Subject to any disclaimer, the term of this patent is extended or adjusted under 35 U.S.C. 154(b) by 0 days.

(21) Appl. No.: 13/788,799

(22) Filed: Mar. 7, 2013

(51) Int. Cl.
*E04B 1/84* (2006.01)
*E04B 1/82* (2006.01)

(52) U.S. Cl.
USPC ..... 181/284; 181/293; 181/295

(58) Field of Classification Search
USPC ..... 181/284, 287, 288, 290, 293, 295, 210, 181/30, 224, 225, 226
See application file for complete search history.

(56) References Cited

U.S. PATENT DOCUMENTS

| | | | | |
|---|---|---|---|---|
| 1,825,465 | A * | 9/1931 | MacDonald | 181/30 |
| 2,357,560 | A * | 9/1944 | Taforo, Jr. | 52/145 |
| 2,855,039 | A * | 10/1958 | Gross | 160/236 |
| 3,049,190 | A * | 8/1962 | Coffman | 181/287 |
| 3,382,947 | A * | 5/1968 | Biggs | 181/30 |
| 3,411,605 | A * | 11/1968 | Coffman et al. | 181/30 |
| 3,590,354 | A * | 6/1971 | Shiflet | 318/245 |
| 4,114,725 | A * | 9/1978 | Croasdale | 181/205 |
| 4,875,312 | A * | 10/1989 | Schwartz | 52/144 |
| 4,971,850 | A * | 11/1990 | Kuan-Hong | 428/137 |
| 5,268,540 | A * | 12/1993 | Rex | 181/210 |
| 5,362,931 | A * | 11/1994 | Fries | 181/284 |
| 5,700,052 | A * | 12/1997 | Yamazaki et al. | 297/217.3 |
| 5,780,785 | A * | 7/1998 | Eckel | 181/295 |
| 5,854,453 | A * | 12/1998 | Fujiwara et al. | 181/293 |
| 6,789,646 | B2 * | 9/2004 | Wang et al. | 181/293 |
| 2002/0175023 | A1 * | 11/2002 | Wilson | 181/293 |
| 2003/0006092 | A1 * | 1/2003 | D'Antonio et al. | 181/293 |
| 2005/0161280 | A1 * | 7/2005 | Furuya | 181/225 |
| 2009/0038883 | A1 * | 2/2009 | Kim | 181/291 |
| 2010/0078258 | A1 * | 4/2010 | Tanabe et al. | 181/224 |
| 2011/0155504 | A1 * | 6/2011 | Tanabe et al. | 181/224 |
| 2012/0067665 | A1 * | 3/2012 | Chae et al. | 181/293 |

FOREIGN PATENT DOCUMENTS

| | | | | |
|---|---|---|---|---|
| JP | 05143081 | A * | 6/1993 | G10K 11/16 |

* cited by examiner

*Primary Examiner* — Edgardo San Martin
(74) *Attorney, Agent, or Firm* — David D. Winters

(57) ABSTRACT

An adjustable sound panel having a sound diffusing element and a sound absorbing element.

5 Claims, 8 Drawing Sheets

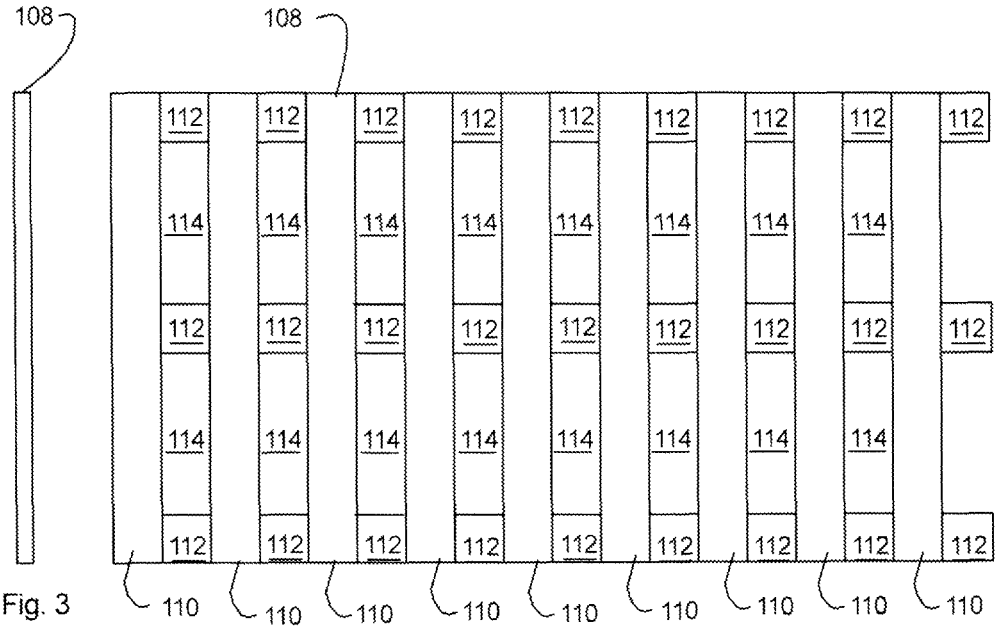
Fig. 3
Fig. 3A
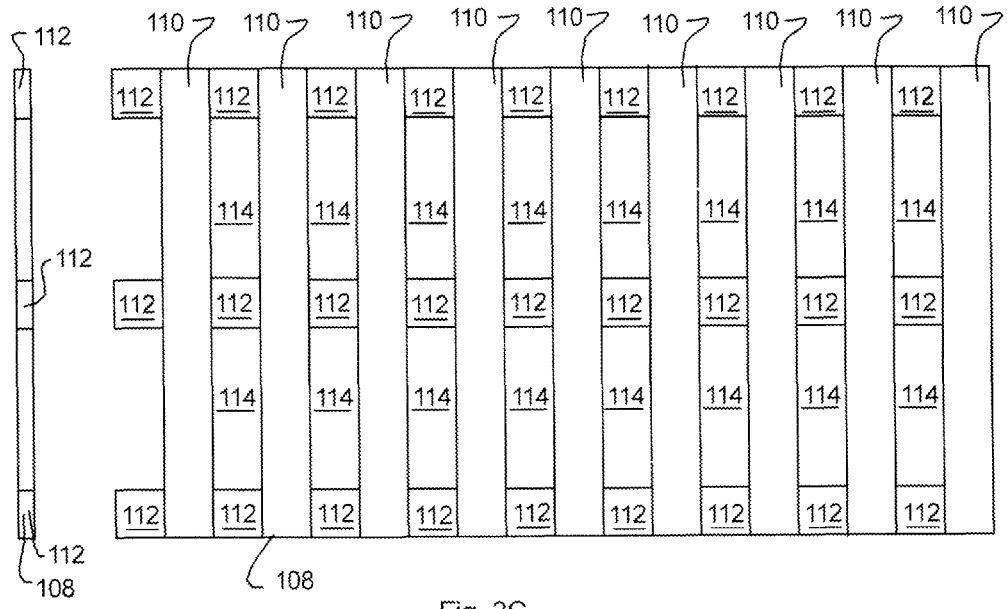
Fig. 3B
Fig. 3C

ADJUSTABLE DEVICE FOR ACOUSTIC MODIFICATION

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

There are numerous venues in which various types of audio are generated for sundry purposes, in example, make-shift or rigorously constructed, recording studios, auditoria, meeting rooms, conference rooms, fellowship halls, churches, sound isolation chambers, sound proof booths, and the like. Further, said venues are often modified, according to well known principles and devices, to have particular acoustic properties according to the type and purpose of the audio produced.

In example, a chamber in which there are minimal reverberations or echoes off of interior surfaces is often desirable. Such a "dead" chamber is created by contriving the inner surfaces thereof to absorb or cancel sound waves thusly reducing or essentially eliminating reverberation. Such absorption or cancellation may be intrinsic to physical characteristics of said surfaces themselves or may be accomplished by electronic means.

If, however, the venue is contrived for public performance hearing of oratory or hearing of music in the presence of a live audience, then a "diffuse" chamber, that is, a room having created reverberation time reduced to the point that echoes are not apparent, may be created by strategic placement of sound panels about the chamber. Such panels may be inert, or may be active electronic. If inert, they are generally contrived to have dimensions and form that cause sound to reflect in sundry angles about the surrounding space. To achieve various ideals of tonal quality, they may be judiciously combined with sound absorbative devices.

It will therefore be readily appreciated by one skilled in the art that devices which absorb sound tend to be intrinsically different from devices which diffuse sound so that one cannot be used for the other purpose.

There are also numerous sound production venues which at various instances might require a "dead," or sound absorbative, room while at other times might require a "diffuse" room. Thus, if such acoustic variation is to occur, then constant removal of diffusing elements and replacement therewith by absorptive elements or vice versa must be undertaken. Such alterations are time consuming, cumbersome, and expensive. Plus, such adjustments are frequently impossible because acoustic properties of most venues are permanently fixed.

The instant art comprises a device which can simply, quickly, easily, and inexpensively be adjusted to exhibit qualities and characteristics ranging absorptive to diffusive. The instant art also provides embodiments which can simultaneously absorb some sound frequencies and diffuse other sound frequencies. Further, the mix of these qualities may vary according to the angle of incidence of arriving sound waves. The instant device further produces the counter intuitive result of enhanced sound absorption capability compared to that of a sound absorption element standing alone.

The instant art can therefore be temporarily or permanently installed in a sound production venue and converted from one set of acoustic characteristics to another and is therefore a needed advancement of the art.

BRIEF SUMMARY OF THE INVENTION

It is an object of the present invention to provide a device easily, quickly, simply, and cheaply adjustable from a sound diffuser to a sound absorber.

It is another object of the present invention to provide a device that may be fabricated simply, cheaply, quickly, and easily.

Yet another object of the present invention is to provide a device that may be easily, simply, quickly, and cheaply installed.

Still another object of the present invention is to increase the amount of sound absorbed by sound absorption elements.

Still yet another object of the present invention is to provide a device which can simultaneously diffuse and absorb sound.

Even yet another object of the present invention is to decrease the surface area of devices needed to acoustically modify a sound production venue.

Even still yet another object of the present invention is to increase the versatility of sound production venues.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 3 is a right side view of an element of the invention.

FIG. 3A is a front view of an element of the invention.

FIG. 3B is a right side view of an element of the invention.

FIG. 3C is a back view of an element of the invention.

LIST OF NUMBERED COMPONENTS

Figure 1:
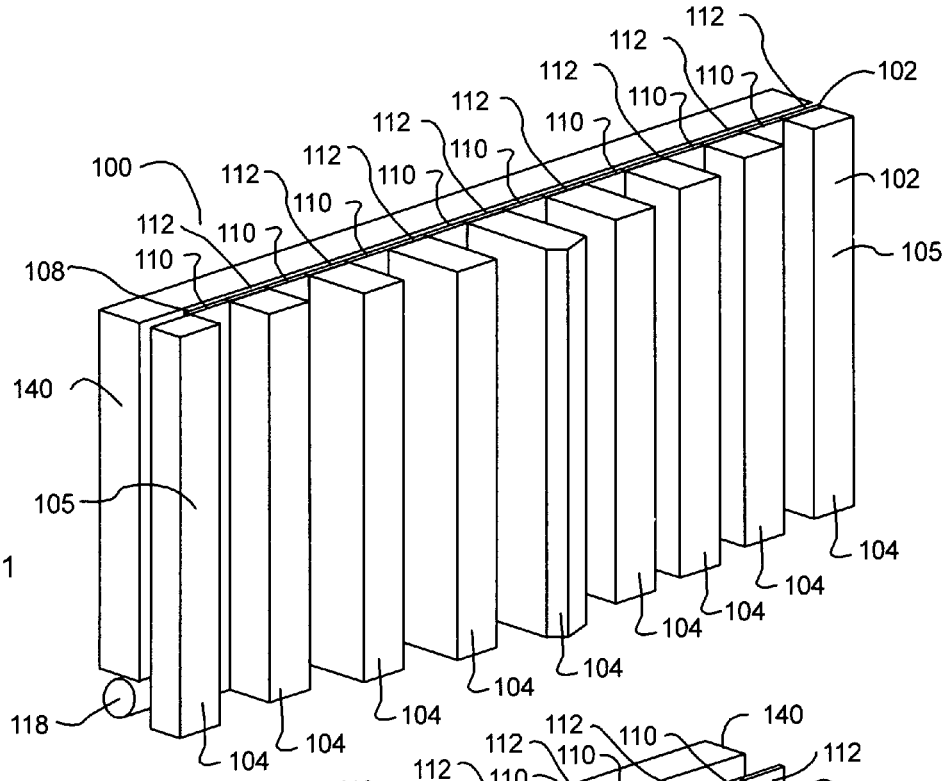
FIG. 1 is an elevational view of an embodiment of the invention.
Figure 1A:
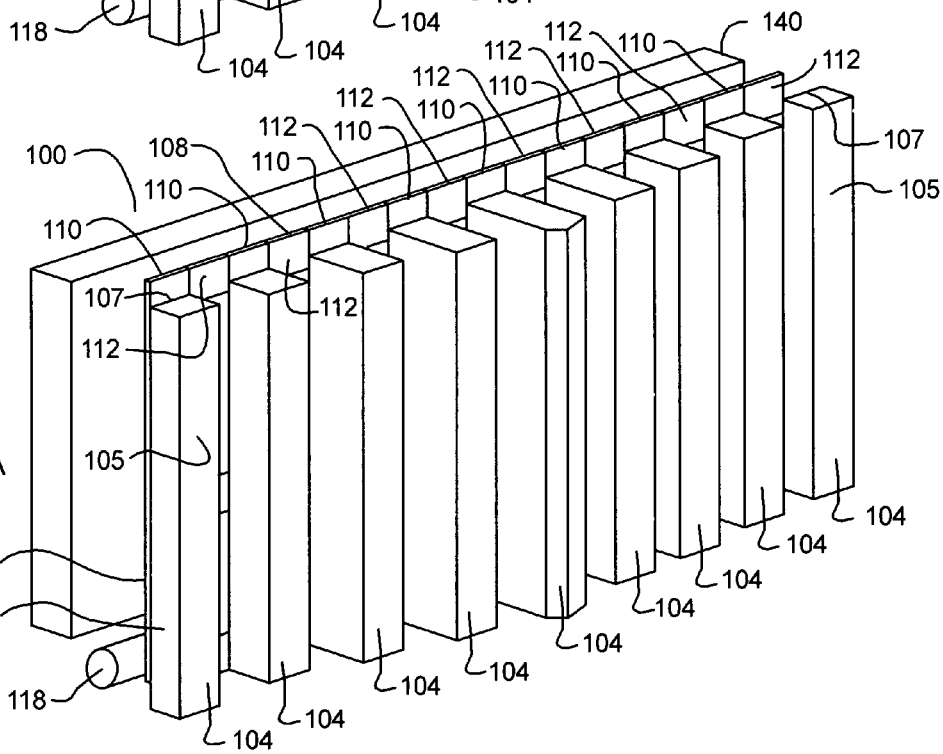
FIG. 1A is an exploded view of an embodiment of the invention.
Figure 2:
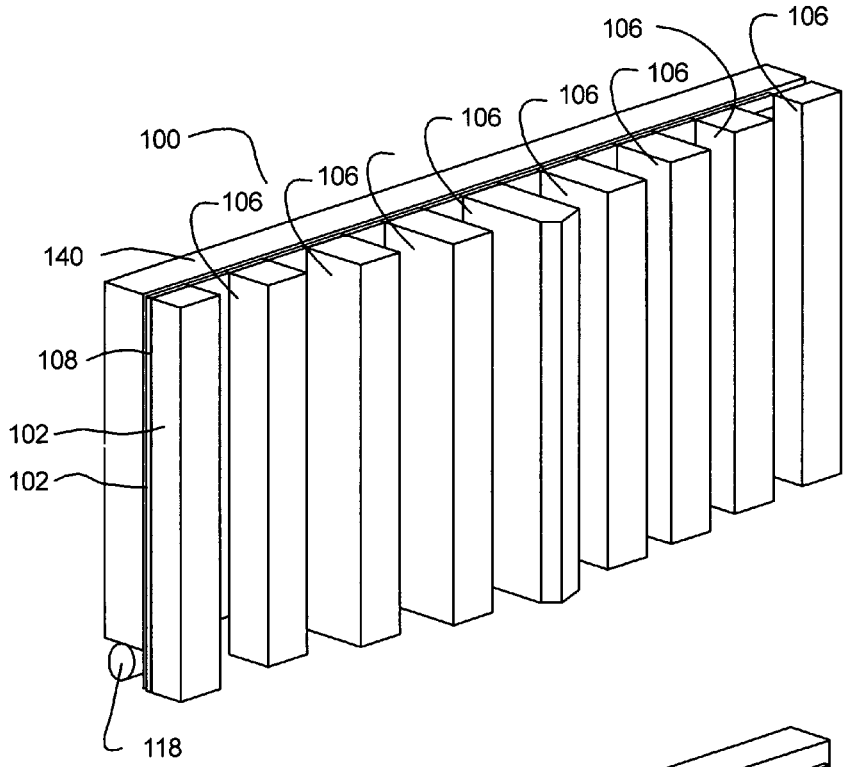
FIG. 2 is an elevational view of an embodiment of the invention.
Figure 2A:
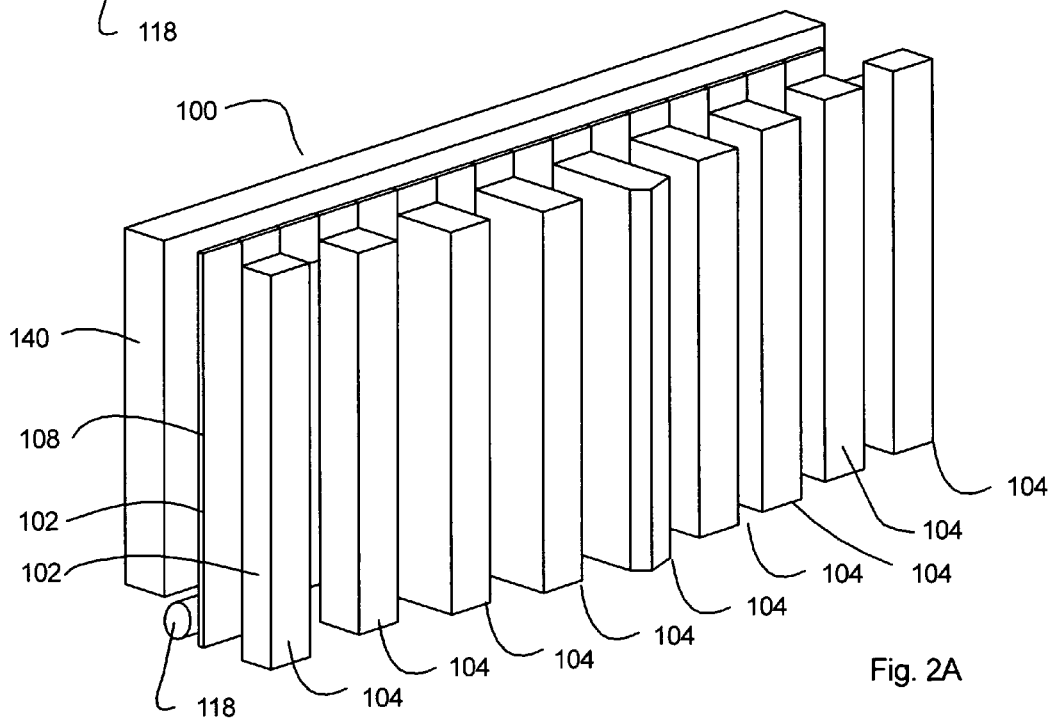
FIG. 2A is an exploded view of an embodiment of the invention.
Figure 4:
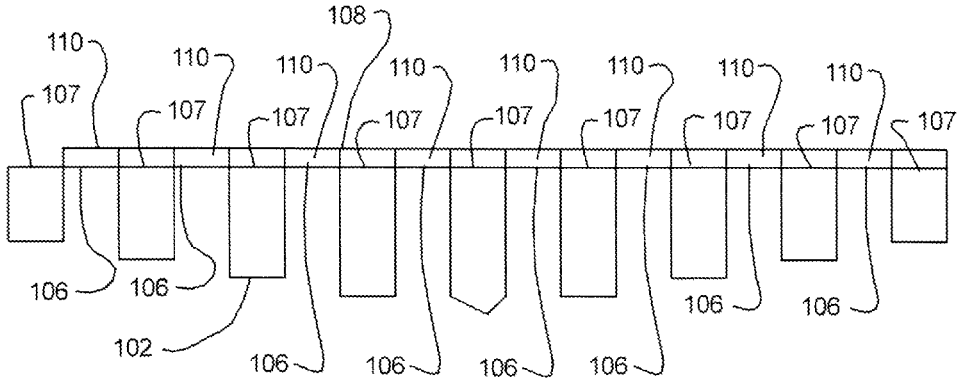
FIG. 4 is a top view of an element of the invention.
Figure 4A:
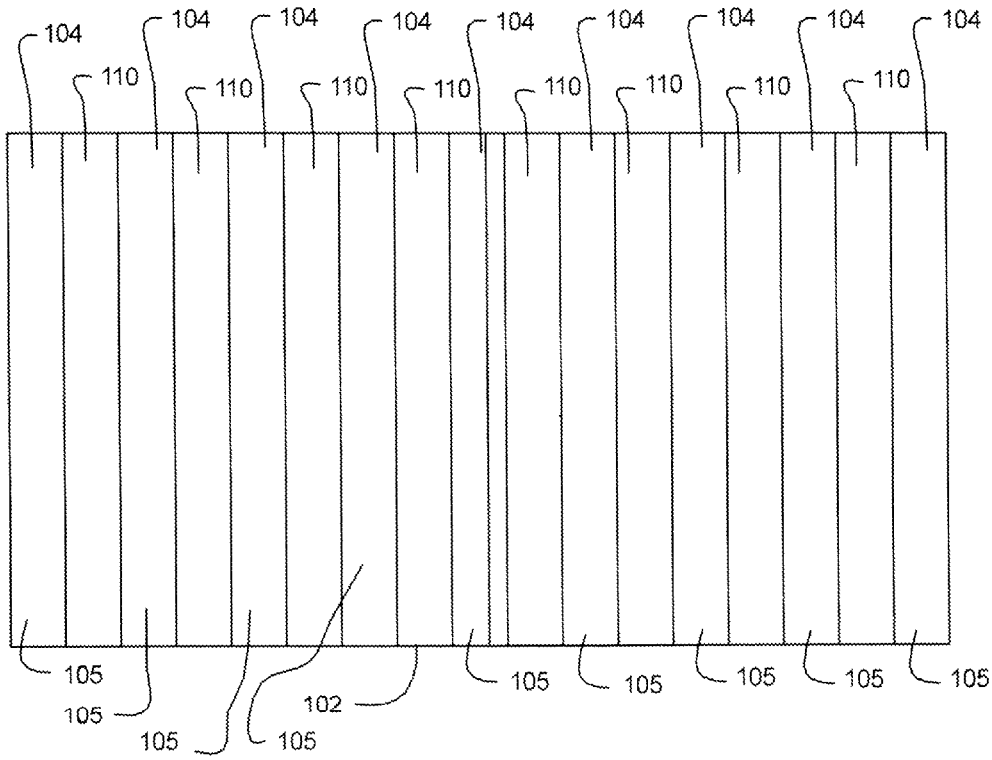
FIG. 4A is a front view of an element of the invention.

100 Adjustable sound panel
102 Adjustable sound diffusing element
104 Sound diffusing element polyhedron
105 Sound diffusing element polyhedron first side
106 Polyhedron space or gap
107 Sound diffusing element polyhedron second side
108 Spacer matrix
110 Polyhedron spacer
112 Spacer tie
114 Spacer matrix aperture
118 Spacer matrix extensor/reflexor
120 Extensor/reflexor shaft
122 Power source interface
124 Switch
126 Spacer matrix slot
140 Sound absorption element
142 Sound absorption element clearance
144 Spacer matrix extensor/reflexor/sound absorption element gap.
150 Adjustable sound panel cabinet
160 Adjustable sound diffusing element gap

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The art of acoustics is well known. Therefore, principles thereof will be mentioned and/or explained only to the extent needed to teach one skilled in the art use of the present invention and words having multiple definitions will be defined as they are commonly used in the art unless otherwise specified or made obvious by the context.

For the purposes of these specification and claims, the term "polyhedron" and forms thereof shall be understood to include all solid geometric figures.

A device well known in the art is a sound diffuser which comprises a reflective surface geometry which will cause an arriving sound wave to be reflected in many different directions. A common type of such a sound diffuser has an irregular surface comprising polyhedral elements of varying dimensions and angles.

FIGS. 1, 1A, 2, and 2A show a adjustable sound panel (100) comprising an adjustable sound diffusing element (102) and a sound absorbing element (140). Noted also is that the adjustable sound diffusing element (102) comprises a series of sound diffusing polyhedrons (104) having spaces or gaps (106) therebetween and a polyhedron spacer matrix (108). Said sound diffusing element polyhedrons (104) have at least a first side (105) and a second side (107), and said sound diffusing element polyhedrons (104) may comprise various suitably reflective materials.

FIGS. 3, 3A, 3B, and 3C show that the polyhedron spacer matrix (108) comprises a series of polyhedron spacers (110) which communicate by means of polyhedron spacer ties (112) having less area than the polyhedron spacers (110). The polyhedron spacer ties (112) are positioned between the polyhedron spacers (110) thusly comprising spacer matrix apertures (114) between the polyhedron spacers (110). The polyhedron spacers (110) and the spacer ties (112) may comprise any suitable material having desired acoustic properties. In example, as will be explained presently, one skilled in the art may deem it appropriate that the polyhedron spacers (110) have sound reflective properties to create sound diffusion while the spacer ties (112) have sound absorptive properties to reduce sound diffusion or have sound reflective properties to enhance sound diffusion.

FIGS. 1, 1A, 4, 4A, and 6 show that the spacer matrix (108) may be positioned essentially contiguous to the sound diffusing element polyhedron second sides (107) so that the polyhedron spacers (110) span the polyhedron spaces or gaps (106). Noted also is that the area of each polyhedron spacer (110) is essentially equal to or greater than the area of each polyhedron space or gap (106). Additionally understood is that the polyhedron spacers (110) comprise any of various suitable materials. Thus, the polyhedron spaces or gaps (106) are fully occluded by the polyhedron spacers (110). Accordingly, it will be understood that, due to the geometry of the sound diffusing polyhedrons (104) configured according to well known acoustic principles, and the polyhedron spacers (110), which by spanning the polyhedron spaces or gaps (106) while remaining essentially contiguous with the diffusing polyhedrons (104) thusly preventing sound from passing through said polyhedron spaces or gaps (106), the adjustable sound diffusing element (102) will diffuse essentially all sound contacting it. In said configuration, comprising the combination of sound diffusing element polyhedrons (104) and polyhedron spacers (110), it will be readily appreciated that the adjustable sound panel (100) causes diffusion of sound waves.

FIGS. 2, 2A, 5, 5A, and 6 show that the spacer matrix (108) may be positioned essentially contiguous to the sound diffusing element second sides (107) so that the spacer matrix apertures (114) and the polyhedron spaces or gaps (106) are essentially aligned to create adjustable sound panel element gaps (160). Thus, it will be understood that some sound that would otherwise strike elements of the sound diffusing element (102) will not strike any said elements but will pass through said sound diffusing element (102) by way of said sound diffusing element gaps (160) and therefore not be reflected or diffused.

Figure 6:
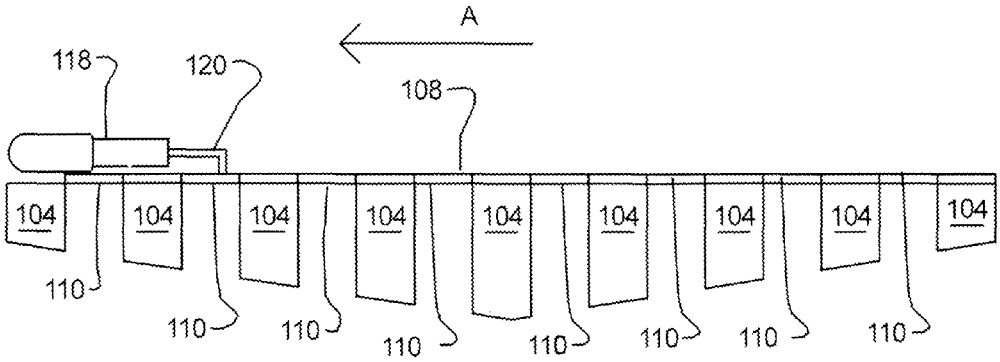
FIG. 6 is a top view of an element of the invention.

It will also be understood that the area of the sound panel element gaps (160) may be increased or decreased by varying the area of the spacer ties (112). It will also be appreciated that the area of the spacer ties (112) may be reduced, as shown in FIG. 6C, to the point that sound reflected or absorbed thereby will be significantly reduced.

However, FIGS. 1, 1A, 2, and 2A show a sound absorption element (140) positioned essentially parallel to the adjustable sound diffusing element (102) so that the aforementioned sound passing through said sound diffusing element gaps (160) will strike said sound absorption element (140) and be absorbed. Said sound is therefore neither diffused nor reflected.

Figure 6A:
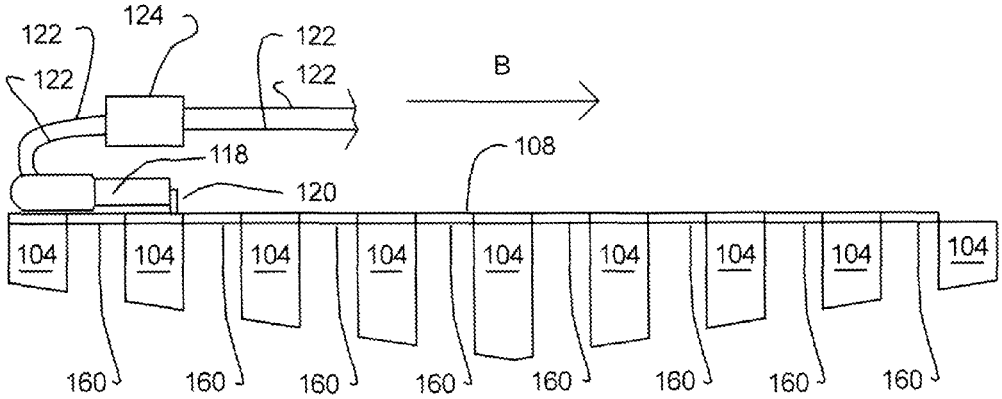
FIG. 6A is a top view of an element of the invention.

Thus, one skilled in the art will readily appreciate that by movement of the spacer matrix (108) from the position shown in FIGS. 1, A, 4, 4A, and 6 to the position shown in FIGS. 2, 2A, 5, 5A, and 6A, characteristics of the adjustable sound panel (100) may be varied from sound diffusion to sound absorption. Also understood is that by opposite movement of the spacer matrix (108), the adjustable sound panel (100) characteristics may be varied from sound absorption to sound diffusion. In example, it will be readily appreciated that movement of the spacer matrix (108) in direction A indicated by arrow, as shown in FIG. 6, will convert the adjustable sound panel (100) characteristics from a sound diffusion to sound absorption. Contrarywise, movement of the spacer matrix (108) in direction B indicated by arrow, as shown in FIG. 6A, will convert the characteristics from absorption to diffusion.

Figure 6B:
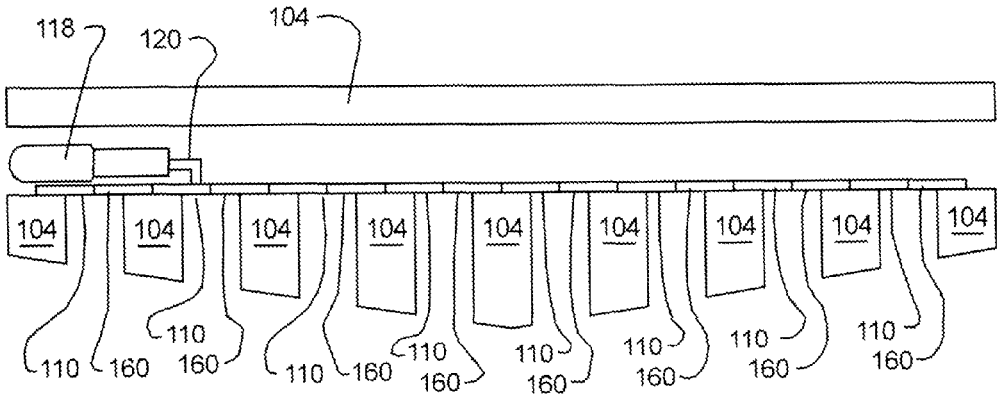
FIG. 6B is a top view of an embodiment of the invention.
Figure 6C:
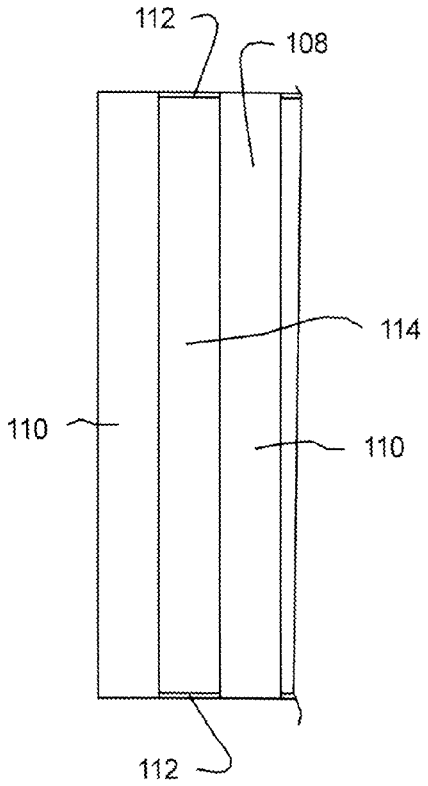
FIG. 6C is a partial front view of an embodiment of an element of the invention.

As seen in FIG. 6B, it will also be readily appreciated that the spacer matrix (108) may be positioned relative the adjustable sound diffusing elements (102) such that the polyhedron spacers (110) do not fully occlude the polyhedron spaces or gaps (106). Thus it will be understood that the area of the adjustable sound diffusing element gap (160) may be adjusted and that thereby the sound passing through said adjustable sound diffusing element gap (160) may be increased or decreased. Therefore, the sound striking the sound absorption element (140) may be increased or decreased. Further, to the extent that the polyhedron spacers (110) combine with the sound diffusing element polyhedrons (104), the sound diffused by the adjustable sound diffusing element (102) may be increased or decreased.

Therefore, it will be understood that while sound is allowed to pass through the partially occluded sound diffusing element gap (160) but at the same time sound is allowed to strike the sound diffusing element polyhedrons (104) and the partially extended polyhedron spacers (110), the adjustable sound panel (100) will simultaneously absorb and diffuse sound. Further, concerning the sound striking the adjustable sound diffusing element (102) the ratio of sound diffused to sound absorbed may be adjusted by varying the extent of the occlusion of the adjustable sound diffusing element gap (160) by the polyhedron spacers (110).

FIGS. 1, 1A, 2, 2A, 6, 6A, and 6B show that the aforementioned movement may be accomplished by a spacer matrix extensor/reflexor (118) which communicates with the spacer matrix (108) by means of a shaft (120). The spacer matrix extensor/reflexor (118) may comprise any device or contrivance capable of rendering linear motion. Many such are known and may be easily adapted for use in the present art by one skilled in the art.

FIG. 6A shows that the extensor/reflexor (118) may be powered by electricity provided by interface with a power source (122), in example by wires, and activation of the extensor/reflexor (118) may be controlled by a switch (124).

Figure 7:
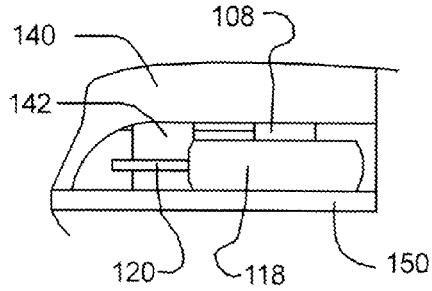
FIG. 7 is a partial back view of elements of the invention.
Figure 7A:
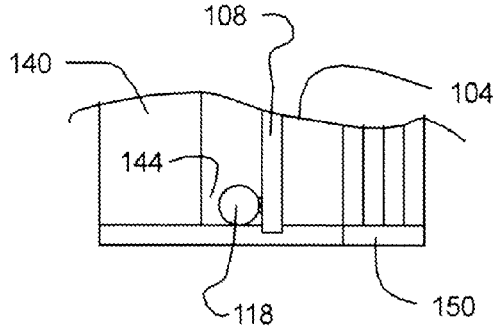
FIG. 7A is a partial left side view of elements of the invention.
Figure 7B:
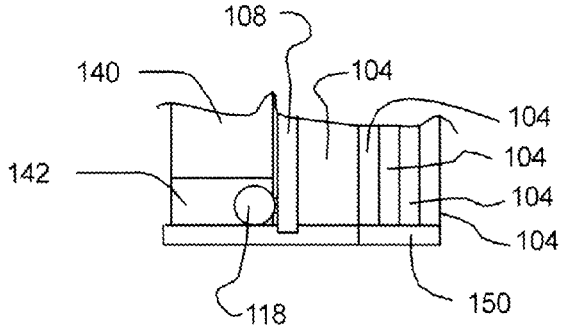
FIG. 7B is a partial left side view of elements of the invention.
Figure 8:
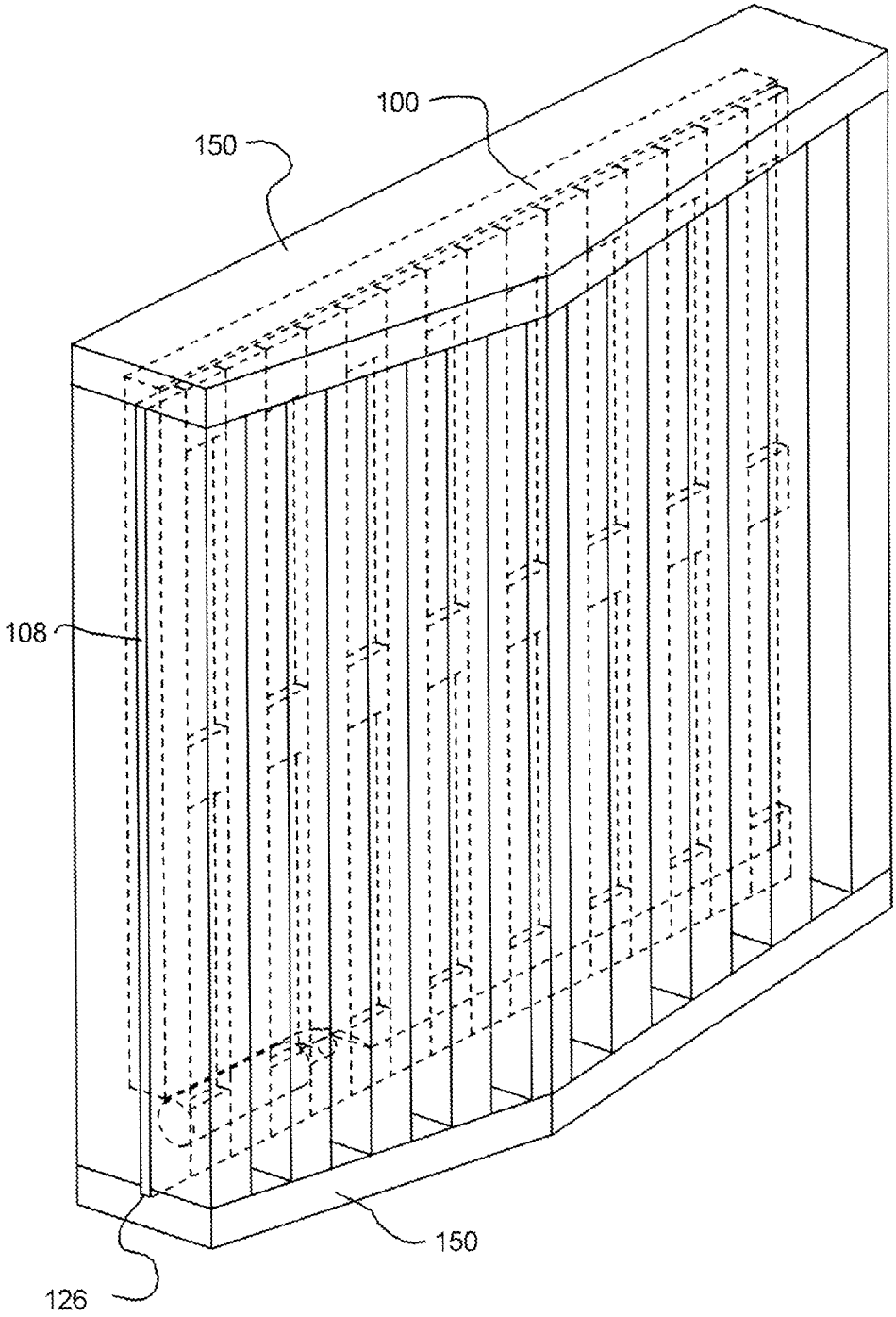
FIG. 8 is an elevational view of an embodiment of the invention with internal elements depicted by broken lines.

FIG. 8 shows that the adjustable sound panel (100) may comprise a container, in example a cabinet (150). It will be readily appreciated that interfaces with the cabinet (150) and elements of the adjustable sound panel (100) such that all elements are disposed in operative position may easily be contrived by one skilled in the art. In example the cabinet (150), as also seen in FIGS. 7, 7A, and 7B, may contain a slot (126) to receive the spacer matrix (108). However, all such interfaces are therefore not shown.

FIG. 7A shows the diffusing element polyhedrons (104) with essentially contiguous spacer matrix (108) comprising the adjustable sound diffusing element (102) communicating with the spacer matrix extensor/reflexor as previously recited and with the sound absorption element (140) disposed essentially parallel to said adjustable sound diffusing element (102) with a gap (144) between the spacer matrix flexor/extensor (118) and said sound absorption element (140). FIGS. 7 and 7B show that the sound absorption element may comprise a clearance (142) allowing the essentially co-planar orientation of the spacer matrix flexor/extensor (118) relative the sound absorption element (140) and the elimination of the gap (144).

Attending to FIGS. 1, 4, 4A, and 6, wherein the polyhedron spacers (110), being juxtaposed with the sound diffusing polyhedrons (14), occlude the polyhedron spaces or gaps (106), one skilled in the art would expect the preponderant majority of sound striking the adjustable sound diffusing element (102) to be diffused, that is reflected in sundry angles according to the cunningly contrived irregular surface thereof. Further, the same would expect the sound absorptive capability of said sound diffusing element (102), as configured in said FIGS. 1, 4, 4A, and 6, to be minimal because the sound diffusing element (102) would prevent sound from contacting the sound absorption element (140) positioned behind said sound diffusing element (102).

Attending to FIGS. 2, 5, 5A, and 6A, wherein the adjustable sound diffusing element (102) is configured so that the polyhedron gaps or spaces (160) are aligned with the spacer matrix apertures (114), being juxtaposed with the sound diffusing element polyhedrons (104), thusly comprising adjustable sound diffusing element gaps (160) between the sound diffusing element polyhedrons (104), one skilled in the art would expect a portion of the sound striking the adjustable sound diffusing element (102) to be diffused, in particular that portion of the sound striking the sound diffusing polyhedron first sides (105). The same would also expect a portion of the sound striking the adjustable sound diffusing element (102) to be absorbed, in particular, that sound which passes through the adjustable sound diffusing element gaps (160) and strikes the sound diffusing element (140).

Further, one skilled in the art would expect that the sound diffused and the sound absorbed would be directly proportional to the area of the adjustable sound diffusing element (102) components positioned between the sound source and the sound absorption element (140), in example sound diffusing element first sides (105) and/or the spacer ties (112), relative to the area of the adjustable sound diffusing element gaps (160). The same would also expect the sound absorbing element (140) standing alone to absorb more sound than in the previously recited combination with the adjustable sound diffusing element (102) whereupon a portion of sound is prevented from contacting the sound absorbing element (140) but is diffused. However, such intuitive result was not observed when the adjustable sound panel (102) and the sound absorption element (140) standing alone were tested in a well known acoustic laboratory.

Contrarywise, the sound absorption of the sound absorbing element (140) in combination with the adjustable sound diffusing element (102) as previously taught, in comparison to the sound absorption of the sound absorption element (140) standing alone was increased at some frequencies, comparable at others, but in no case directly proportional to the ratio of the areas of sound diffusing surfaces relative the area of the sound passages. In some frequencies and configurations, absorption by this panel (100) equipped with absorbing elements (140) and diffusing elements (102) was found to be greater than absorption by an equally dimensioned panel made solely of absorption element material.

Figure 5:
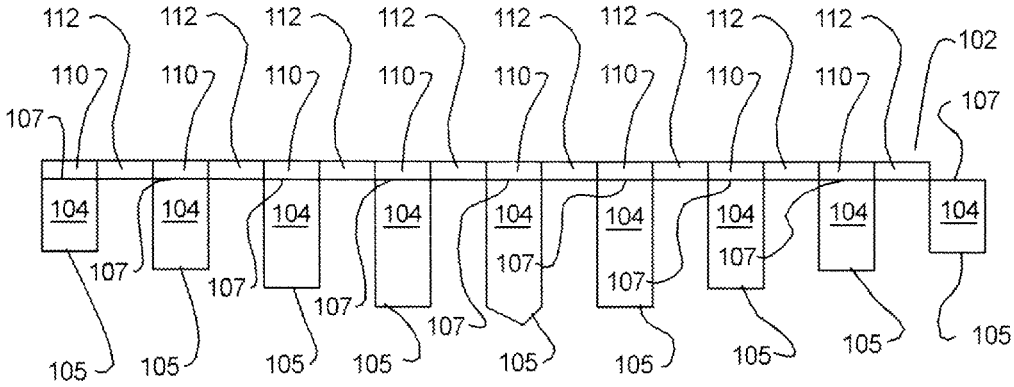
FIG. 5 is a top view of an element of the invention.
Figure 5A:
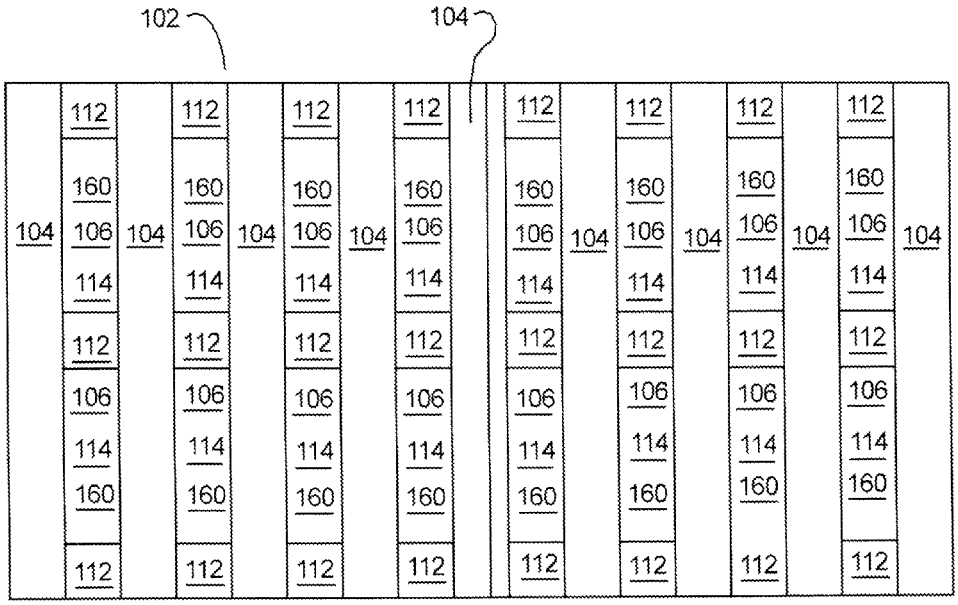
FIG. 5A is a front view of an element of the invention.
Figure 5B:
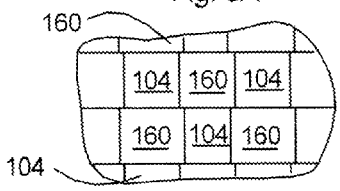
FIG. 5B is a partial view of an embodiment of the invention.

While the sound diffusing element polyhedrons (104) have been depicted as being substantially rectangularly elongated and positioned essentially side by side with the adjustable sound diffusing element gaps (160), the adjustable sound panel (100) is not intended to be limited to such configuration, in example, FIG. 5B shows that the sound diffusing element polyhedrons (104) need not be essentially elongated and that a plurality might be disposed vertically alternately with adjustable sound diffusing element gaps (160) while the same arrangement also comprises horizontal rows comprising said sound diffusing element polyhedrons (104) with the adjustable sound diffusing element gaps (160) therebetween.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An adjustable sound panel comprising:

a sound diffusing element; and a sound absorbing element;

the sound diffusing element comprising one or more gaps or spaces which allow the pass through of sound;

the sound diffusing element comprising means to totally or partially occlude one or more of said gaps or spaces;

the sound diffusing element and the sound absorbing element positioned such that sound passing through said sound diffusing element one or more gaps or spaces will contact the sound absorbing element;

the sound diffusing element and the sound absorbing element positioned such that sound passing through said sound diffusing element one or more gaps or spaces will pass through said one or more gaps or spaces prior to contacting said sound absorbing element.

2. A device as in claim 1, the complete or partial occlusion means comprising a spacer matrix having one or more spacers having areas essentially equal to or greater than the area of said one or more sound diffusing element spaces or gaps and said spacer matrix comprising apertures, the matrix movable in such a way as to juxtapose said one or more spacers with the one or more sound diffusing element gaps or spaces such that said diffusing element gaps or spaces are totally or partially occluded and wherein said spacer matrix is movable to juxtapose said one or more spacer matrix apertures with said one or more panel element gaps or spaces thusly comprising one or more sound diffusing element gaps.

3. A device as in claim 2, the adjustable sound panel comprising a cabinet.

4. A device as in claim 2, the sound diffusing element and the sound absorbing element disposed relative each other such that the sound absorption capacity of the adjustable sound panel comprising said sound diffusing element and said sound absorption element is greater than the sound absorption capacity of said sound absorption element standing alone.

5. A device as in claim 2, movement of the spacer matrix accomplished by an electric motor activated or deactivated by a switch.

* * * * *